United States Patent [19]

McPhee et al.

[11] 4,280,568

[45] Jul. 28, 1981

[54] SIDEWALL SAMPLING APPARATUS

[75] Inventors: William A. McPhee; Junius L. Speights, both of Houston, Tex.

[73] Assignee: Dresser Industries, Inc., Dallas, Tex.

[21] Appl. No.: 117,751

[22] Filed: Feb. 1, 1980

[51] Int. Cl.[3] ..... E21B 25/04; E21B 25/10

[52] U.S. Cl. ..... 175/4; 175/20; 245/404

[58] Field of Search ..... 175/3, 4, 4.57, 20; 47/485, 73; 285/305, 404; 111/1, 7.1, 92, 99; 408/703

[56] References Cited

U.S. PATENT DOCUMENTS

| | | | |
|---|---|---|---|
| 573,695 | 12/1896 | Penfield | 285/305 X |
| 2,052,394 | 8/1936 | Fullman | 285/404 X |
| 2,775,427 | 12/1956 | Leone | 175/4 X |
| 2,848,195 | 8/1958 | Porter | 175/4 |
| 2,923,530 | 2/1960 | Fields | 175/4 X |
| 2,937,005 | 5/1960 | Porter | 175/4 X |
| 3,142,273 | 7/1964 | Dilts | 111/7.1 |
| 3,419,089 | 12/1968 | Venghiattis | 175/4.57 |
| 3,429,383 | 2/1969 | Pardue | 175/4 |
| 3,755,962 | 9/1973 | Walters et al. | 111/1 X |
| 4,129,401 | 12/1978 | Berthier | 408/703 |

FOREIGN PATENT DOCUMENTS

| | | | |
|---|---|---|---|
| 1140634 | 7/1957 | France | 285/305 |
| 28420 | 10/1942 | India | 47/73 |
| 1277385 | 6/1972 | United Kingdom | 285/305 |

*Primary Examiner*—James A. Leppink
*Assistant Examiner*—George A. Suchfield
*Attorney, Agent, or Firm*—Richard M. Bryon; Patrick H. McCollum

[57] ABSTRACT

Apparatus for taking a sample of earth formations surrounding a borehole. A core sampling projectile is provided which has a core-taking barrel with a frontal cutting edge and is releasable secured to a base member of relatively more mass than the barrel. The base member has an enlarged outer diameter annular abutment thereby limiting the depth of penetration of the core-taking barrel to a predetermined distance.

3 Claims, 3 Drawing Figures

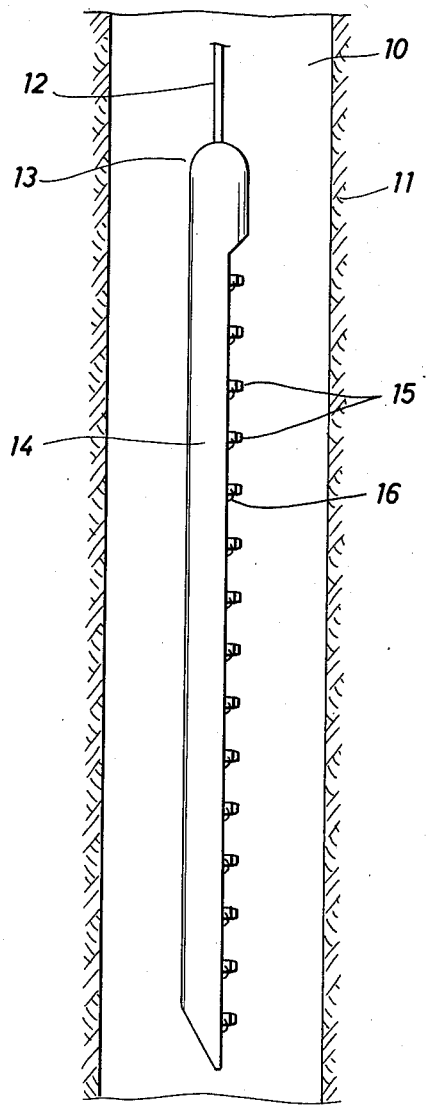
FIG. 1
FIG. 2
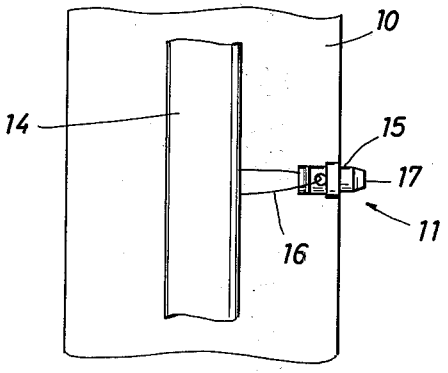
FIG. 3
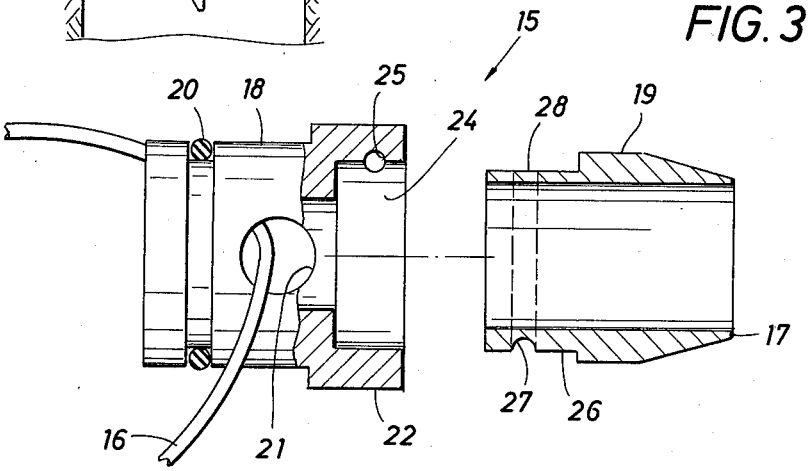

SIDEWALL SAMPLING APPARATUS

BACKGROUND OF THE INVENTION

The present invention relates to apparatus for obtaining samples of earth formations and, more particularly, to new and improved core-sampling apparatus for obtaining a sample of earth formation surrounding a borehole.

There is a need in the oil and gas industry for a means for obtaining intact samples representative of the earth formations at various elevations of a borehole. Such samples, commonly referred to as "cores", may have structures ranging from relatively hard to those which are soft and fragile. Retrieved core samples may be analyzed to determine the nature of the fluids, whether gas, oil or water, with which they are saturated. Further, certain physical characteristics of the formation, such as permeability and porosity, may be determined.

A technique for obtaining core samples of the formation involves the use of a wireline-type instrument for selectively taking samples from the wall of the borehole of any desired level. This tool, referred to as a "Sidewall Sampler", generally includes an elongated body member containing along its length a plurality of sample receiving projectiles. The projectiles each consist of a hollow cylinder having an open end and capable of receiving a sample of the material of the side wall formation upon shooting the cylinder into the formation.

The projectiles are shot into the formation by igniting a propellant charge placed in the instrument behind the projectile. The propellant charges are detonated electrically at the desired level within the borehole by remote control. The projectiles are attached to the housing of the instrument by means of small cables, so that after they have been fired they may be retrieved, with the core sample therein, upon raising the instrument to the surface.

It has been shown that the design of the projectile is influenced by the hardness of the formation from which the core is desired. One prior art design attempts to facilitate recovery of the core projectile by providing a core barrel with a separable forward portion in the form of an annular cutting ring which generally has a slightly greater diameter than the core barrel. When a core barrel of this design enters a formation the enlarged annular ring creates a core hole slightly larger than the core barrel. Upon withdrawal of the core barrel from the formation, the core barrel separates from the annular ring and is easily extracted since the core hole is slightly larger than the core barrel. Such prior art core barrels have been shown to be less than ideal in that the annular ring will at times separate from the core barrel prior to contacting the formation or the ring will stick on the core barrel within the formation making core barrel retrieval a difficult task.

Another prior art core barrel has attempted to solve the retrieval problem by providing a relatively heavy core barrel with a large frontal cutting area. Upon penetration of the formation this core barrel fractures the surrounding formation thereby reducing the resistance to the extraction of the barrel. However, quite often the fracturing of the surrounding formation also causes fracturing of the core sample. Such fracturing can result in large portions of the core sample falling from the barrel during recovery. Another problem with a relatively massive core barrel is that the size of the charge required to cause the needed formation penetration is unnecessarily large.

Accordingly, the present invention overcomes the deficiencies of the prior art by providing method and apparatus for obtaining subsurface formation samples by the use of a replaceable core sample barrel utilizing a relatively small cutting head and a limited penetration distance.

SUMMARY OF THE INVENTION

Apparatus for investigating earth formations according to the present invention includes a gun body member for receiving a plurality of core sampling projectiles disposed adjacent one another lengthwise along the gun body and adapted to be impelled toward and into the subsurface earth formation by a charge. The projectile body is composed of a lower tubular core barrel base which may be slidably inserted into the gun body in a relatively gas-tight manner, so that expanding gases produced by the ignition of a propelling charge of explosive will effectively discharge the projectile. The base member is provided with an aperture through which a single cable passes and is fixed to the body at both ends to facilitate removal of the core barrel from the subsurface earth formations.

The core barrel base is provided with an enlarged diameter at the distal end and is adapted to receive in the internal portion thereof the reduced diameter portion of a core barrel. The core barrel is retained within the barrel base member by means of a twist-locking system so that the barrel can be easily changed without removing from the gun body the barrel base member in accordance with the characteristics of the formation to be sampled. The core barrel is of a smaller diameter than the barrel base member creating an abutment designed to allow the core barrel to penetrate the formation a predetermined distance. Controlling the depth of penetration allows for each of removal of the core barrel from the formation along with reducing the chance of damage to the sample.

Accordingly, it is a feature of the present invention to provide new and improved subsurface core-taking apparatus.

Another feature of the present invention is to provide new and improved core-taking projectiles in which a separable core barrel is used to provide ease of exchange of the barrels to accommodate the formation characteristics.

Yet another feature of the present invention to provide a core-taking projectile wherein the depth of penetration into the formation is predetermined and controlled allowing ease of retraction and better core quality.

It is still a further feature of the present invention to provide a core sample barrel with a reduced frontal area to provide penetration of subsurface formations with reduced energy.

It is yet a further feature of the present invention to provide a removal cable which automatically centers itself allowing equal pulling force for increased barrel removal efficiency.

A further feature of the present invention is to provide new and improved core-taking projectiles which are simple and inexpensive in management as well as versatile, efficient and reliable under a variety of field operations.

BRIEF DESCRIPTION OF THE DRAWINGS

FIG. 1 is a pictorial view, partly in cross-section, of a sidewall sampler disposed in a typical borehole.

FIG. 2 is a view of a coring projectile which has been discharged into an adjacent formation.

FIG. 3 is a more detailed view of the sidewall projectile of the present invention.

DETAILED DESCRIPTION OF THE PREFERRED EMBODIMENT

Referring now to the drawings in more detail, especially to FIG. 1, there is illustrated a portion of a borehole 10 penetrating the earth formation 11. Disposed within borehole 10 by means of cable or wireline 12 is sidewall core sampling apparatus 13. Core sampling apparatus 13 is comprised of an elongated body member 14 and a plurality of core sampling bullets 15 disposed adjacent one another lengthwise along the body member 14. Each projectile 15 is attached to body member 14 by means of a cable 16 or other flexible linking means of suitable design.

Referring to FIG. 2, there is depicted therein a section of the borehole 10 and body member 14 hereinbefore mentioned, wherein the projectile 15 has been discharged into the wall of the borehole 11 in a manner to take a sample of the adjacent earth. The projectile 15 is provided with a cutting edge 17 to cut a corehole upon impacting with the formation 11. The attached cable 16 is long enough to permit the projectile 15 to penetrate the formation 11. When the body member 14 is drawn out of the borehole 10, cable 16 will serve to pull each projectile 15 out of its respective corehole and to carry it upwards in order that the cores contained in each projectile 15 may be recovered at the surface for testing and analysis.

As may be seen in FIG. 3, the complete projectile 15 includes a core barrel base 18 and a core cutting barrel 19. In the preferred embodiment, base member 18 is provided with an o-ring 20 located in a circumferential groove or seat so that when base member 18 is slidably inserted into gun body 14 it will result in a relatively gas-tight seal so that expanding gases produced by the ignition of a propelling charge of powder (not shown) will effectively discharge the projectile 15. The o-ring seal further prevents borehole fluids from entering the firing chamber.

Barrel base member 18 is provided with aperture 21 throughwhich flexible retrieving wire 16 is passed. Flexible retrieving wire 16 is threadable connected to body member 14 to provide a means for dislodging projectile 15 from formation 11 upon the upward movement of body member 14. By utilizing a single flexible retrieval wire 16 instead of a pair of wires, retrieval wire 16 will automatically center itself in relation to barrel base member 18 allowing equal pull pressure on both sides of flexible wire 16 thereby reducing breakage of wire 16 and making removal more reliable. Barrel base member 18 is further provided with an area of increased diameter 22 located at the outer portion and an internal cavity area 24 for the receipt of core barrel 19. Barrel base member 18 is also provided with aperture 25 of relatively small diameter suitable for retaining a roll pin or similar device (not shown).

Now turning to the second part of projectile 15, core barrel 19 is of a smooth bore character with a reduced outer diameter at the rear portion 26. Groove 27 is partially circumferential leaving section 28 of the reduced diameter area as a flat surface. In the assemble of projectile 15 the rear portion 26 of core barrel 19 is slid into cavity 24 of barrel base 18. Flat section 28 of core barrel 19 is aligned with the portion of base member 18 corresponding to aperture 25 throughwhich a pin has been driven. So that core barrel 19 will be retained within base 18, core barrel 19 is rotated once inserted so that the pin located within aperture 25 will locate within groove 27 thereby retaining core barrel 19 locked within base member 18. By such configuration there is provided a quick and easy way of changing core barrel 19 without removing barrel base 18 from the gun body 14. Providing a simple and fast method of changing core barrel 19 substantially reduces the time and cost of preparing a core gun for field use under varying formation characteristics.

In the operation of the apparatus as depicted in the drawings, projectile 15 is slidably inserted in gun member 14 over a combustible charge. The gun member 14 is lowered to a depth within an earth borehole where there is desired a sample of the formation for analysis. The charge is ignited thereby propelling projectile 15 out and causing a portion thereof to penetrate the formation. Due to the design of projectile 15, core barrel 19 will cut into the formation until the enlarged forward portion of barrel base member 18 contacts the formation halting further penetration. By controlling the depth of penetration in this manner there is eliminated the need for a massive frontal area 17 on barrel 19 resulting in a barrel of reduced mass causing significantly less formation damage due to impact shock. A further benefit of a controlled penetration of the core barrel is a reduction in the explosive charge required to achieve the depth of penetration.

Upon completion of the coring operation gun member 14 is raised by means of a cable 12. The raising of gun member 14 causes cable 16 attached thereto to center itself relative to barrel base member 18 thereafter pulling core barrel 19 from the formation 11. Gun member 14 is returned to the surface where core barrel 19 can be quickly disconnected from base member 20 and sent to the laboratory where core analysis can be conducted.

Many modifications and variations besides those specifically mentioned may be made in the techniques and structures described herein and depicted in the accompanying drawings without departing substantially from the concept of the present invention. For example, instead of a twist-lock method of retaining the core barrel within the base member the retention can be achieved by means of a set screw. Accordingly, it should be clearly understood that the forms of the invention described and illustrated herein are exemplary only, and are not intended as limitations on the scope of the present invention.

The embodiments of the invention in which an exclusive property or privilege is claimed are defined as follows:

1. A formation core-taking apparatus for obtaining samples of formations traversed by a borehole, comprising:

an elongated gun body member for traversing said borehole;

an open-ended tubular core-taking member having a formation penetrating forward end and a truncated circular cross-section rearward end;

a groove traversing partially about the outside circumference of said rearward end of said core-taking member;

a base member having a rearward end carried on said gun body member said base member having an enlarged diameter annular area frontal section;

a circular cross-section internal cavity within the frontal section of said base member for receiving said rearward end of said core-taking member;

means to detachably secure said core-taking member within said base member said means having a roll pin member partially within said internal cavity thereby partially truncating said cavity;

said roll pin member slidably fitting into said groove when said core-taking member is twisted in said base member; and an explosive charge for propelling said base member and said core barrel from said gun body member into said formation.

2. The core-taking apparatus of claim 1 further comprising:

a passage traversing the diameter of said base member; and a single flexible wire connected at both ends to said gun body member and passing through said passage for retrieving said core-taking apparatus from said formation .

3. A formation core-taking apparatus for obtaining samples of earth formations surrounding a borehole, comprising:

an elongated gun member for traversing said borehole;

a tubular core barrel having a chamfer angled formation penetrating forward end and a truncated circular cross-sectional rearward end having a groove traversing partially about the outside circumference of said rearward end;

a base member having a rearward end carried on said gun member and having an enlarged diameter annular area frontal section having a circular-cross section internal cavity therein for receiving a portion of said core barrel;

means to detachably secure said core barrel within said internal cavity said means having a roll pin partially truncating said cavity for slidable receipt into said groove when said core barrel is inserted into said cavity; and an explosive charge for propelling said core-taking apparatus from said gun member into penetration of said formation, said penetration being substantially limited by the impacting of said enlarged diameter annular frontal section upon said formation to the length of said core barrel.

* * * * *